428-919 SR
9/25/84 XR 4,473,087

United States Patent [19]
Cavender

[11] Patent Number: 4,473,087
[45] Date of Patent: Sep. 25, 1984

[54] COMBINATION CAMOUFLAGED HUNTING BLIND AND WINDBREAK AND METHOD OF ERECTING

[76] Inventor: John L. Cavender, P.O. Box 685, Moorhead, Miss. 38761

[21] Appl. No.: 546,535

[22] Filed: Oct. 28, 1983

[51] Int. Cl.[3] ..... E04B 1/347; A45F 1/06

[52] U.S. Cl. ..... 135/87; 135/901; 135/905; 428/919

[58] Field of Search ..... 135/901, 117, 903, 87, 135/90, 95, 96, 97, 905; 256/23, 24, 25, 29, 73; 43/1; 47/26, 28 R, 31; 52/63, 83, 206, 660, DIG. 11, DIG. 12

[56] References Cited

U.S. PATENT DOCUMENTS 550,762 12/1895 Murphy et al. ..... 43/1 X
2,370,734 3/1945 Jost ..... 428/919 X
3,442,275 5/1969 Ternes ..... 135/87
3,690,334 9/1972 Miller ..... 135/901 X

FOREIGN PATENT DOCUMENTS 261102 6/1963 Australia ..... 135/87
2254273 6/1975 France ..... 47/31

*Primary Examiner*—Robert A. Hafer
*Assistant Examiner*—Arnold W. Kramer

[57] ABSTRACT

A combination camouflaged hunting blind and windbreak having ropes attached for securing to and around trees in a manner to enclose an area of sufficient size to allow a hunter freedom of movement while remaining hidden from the surrounding game and protected from the wind. A lower panel is connected to a top strip by spaced apart connections to form elongated openings for the hunter to both see and shoot through in any direction.

8 Claims, 2 Drawing Figures

COMBINATION CAMOUFLAGED HUNTING BLIND AND WINDBREAK AND METHOD OF ERECTING

BACKGROUND OF THE INVENTION

The present invention generally relates to blinds and windbreaks as used by hunters.

DESCRIPTION OF PRIOR ART

The prior art relating to hunters' blinds and windbreaks are generally more complex and of a limited size rendering them difficult to pack in and out of the woods, as well as unsuitable for use by more than one person in a manner so as to avoid startling game animals. In addition, these prior art blinds deprive the hunter of the benefit of the warming rays of the sun and restrict his movement resulting in cramped limbs.

SUMMARY OF THE INVENTION

The present invention overcomes the limitations and complexities of the prior art by providing a simple and effective blind to screen hunters from their intended prey while allowing them clear freedom of movement over a relatively large area. In addition, it eliminates the need for added support poles or frames as are found in many blinds in the prior art. This elimination of extra supports renders the blind easier to pack and carry through the woods, as well as substantially noise free. The blind also acts as a good windbreak while allowing the hunter the benefit of the warmth of the sun and the ability to move around.

According to this invention, the improved combination camouflaged hunting blind and windbreak is formed from a rectangular screen of flexible material which is sufficiently long to enclose an area large enough to permit at least one hunter freedom of movement within the confines of the screen. Near the upper edge of the screen a plurality of elongated openings are provided which offers the hunter or hunters an unobstructed view therethrough. Means are provided to attach the screen to vertical objects such as trees, bushes, and the like. A camouflage pattern is provided on one side of the screen. Typically, the rectangular screen will measure between about 30 and 50 inches in height and between about 20 and 50 yards in length.

In one embodiment of the invention, the elongated openings are provided as a row of rectangular cut-outs below the upper edge of the rectangular screen. In another embodiment, the elongated openings are formed by connecting a separate elongated rectangular strip of material to the upper edge of a rectangular panel such that the openings will be defined by the upper edge of the panel and the lower edge of the strip and by the consecutive pairs of the connecting means.

The preferred form of the connecting means includes one or more sets of ropes extending beyond the sides of the screen with sufficient length to tie around a tree or other vertical objects.

The invention will now be described in greater detail with the aid of the accompanying drawing.

DETAILED DESCRIPTION OF THE INVENTION AND PREFERRED EMBODIMENTS

Figure 1:
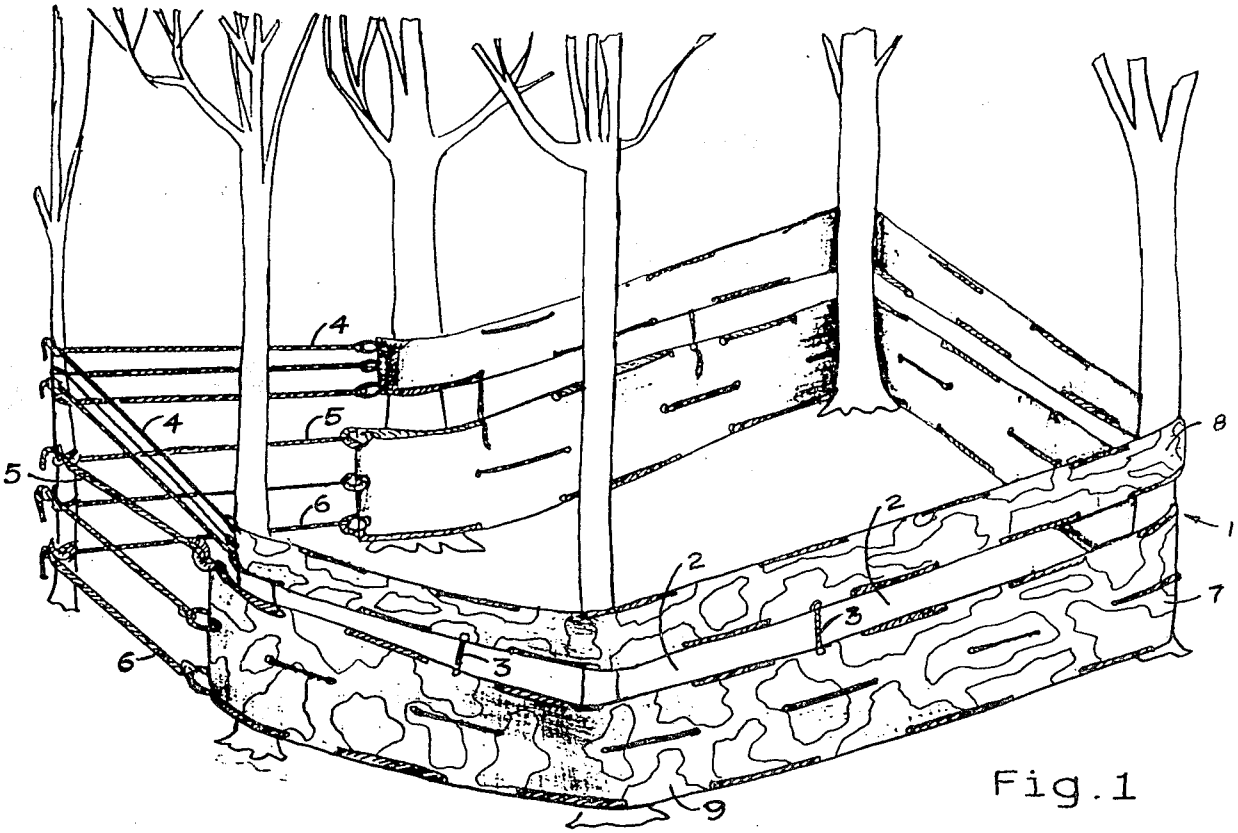
FIG. 1 is a perspective view of the blind and windbreak in an erected condition.
Figure 2:
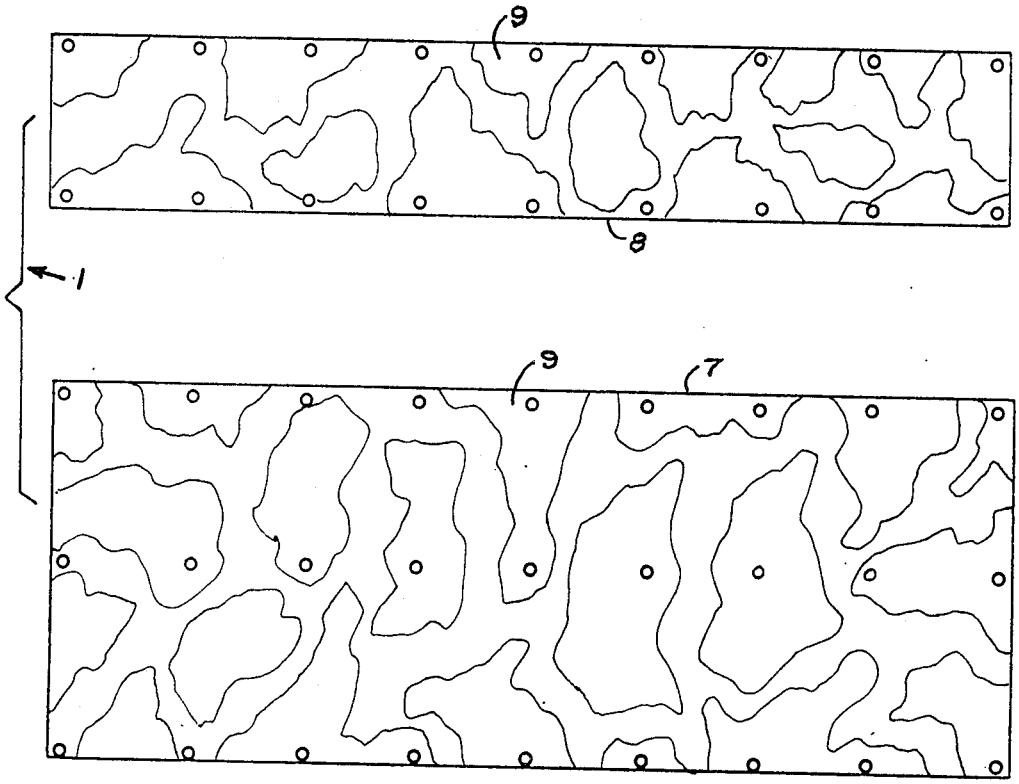
FIG. 2 is a view of the lower panel and upper strip which are utilized in forming the blind and windbreak by running ropes through the grommets or holes shown.

According to this invention, a combination camouflaged hunting blind and windbreak is provided consisting of a rectangular screen 1 of flexible material such as canvas, vinyl, plastic or the like having a camouflage design, for example, resembling thick woods, including, for example, bushes, trees, undergrowth, etc., on one side. Any material which can withstand the elements, is tear resistant and relatively lightweight can be used. Spaced inward from and along the upper edge of the screen are a plurality of elongated openings 2 separated by suitable connecting means 3, for example, strips of blind material. These openings, which may be from one to three feet in length and from six to eight inches high, provide an unobstructed view through the blind and allow the hunter or hunters to see out and to shoot surrounding game while remaining safely hidden.

Preferably, these elongated openings are formed as rectangular cut-outs in the flexible material. Although the openings are shown as a single row, it would also be possible to have the openings staggered or to provide two or more rows of openings to accomodate hunters of different heights.

Generally these openings are located from about 20 to 45 inches off the ground so that a hunter in a sitting position will be able to comfortably see through the openings and detect both small and large animals.

Instead of cut-out openings, the opening can be formed by having the uppermost section 8 as a separate elongated rectangular strip of flexible material which may be the same or different as the material of the main panel section 7, connected to the main panel section 7 by the connecting means 3. The connecting means may also be formed from the same fabric material as either or both of the sections 7 and 8 or a different type of fabric or yarn, rope, etc. can be used. Furthermore, the strip 8 may be permanently secured to the main panel 7 by sewing, stapling, gluing, fusing, or otherwise permanently attaching the opposite ends of the connecting means 3 to the main section 7 and strip 8, respectively. Alternatively, the connecting means may be removable from either or both of the sections of the blind, for example, using "Velcro" connectors, buttons, snaps, etc.

As support means three strong but light weight ropes are provided extending the full length of and beyond the side edges of the blind panel for example, about ten feet to either side for tying to existing trees or bushes. A first rope 4 is connected at both ends of the strip 8 of the blind as a first support means to hold the strip of blind material above the slots steady. A second rope 5 is connected to both side edges of the blind immediately below the openings as the main support for the blind panel. A third rope 6 is connected to both side edges of the bottom edge of the blind to secure this edge so it does not move in the wind and startle the surrounding game. The ropes may be of continuous length extending through loops provided on the back side of the blind material or separate pieces of rope may be attached to the side edges of the blind material.

As an alternative to ropes as the securing means spikes, staples, nails, adhesive strips, and the like may be used to secure the edges of the blind material to the trees, bushes, or other vertical objects. Ropes are the preferred securing means.

The rectangular panel 1 is of sufficient size to enclose an area that allows the hunter freedom of movement without startling the game and is preferably thirty to fifty inches high and twenty to fifty yards long.

As noted above, the camouflaged design 9 may be a typical forest screne or any other design to obscure the presence of the combined blind and windbreak. The design may be printed or painted on the flexible blind material or a separate removable design may be provided.

In use, the blind panel is carried into the woods and unrolled. Using the ten foot lengths of rope at one end, the panel is securely tied to a stout tree or bush then spread out around one or more trees or bushes with the camouflaged side facing outward and the edge with the openings uppermost. The other end is then brought around and tied to the first tree or bush, or to a tree or bush near the first tree or bush enclosing an area having a perimeter equal to the length of the blind material and varying in shape depending on the position of the trees and bushes used. In this manner, the hunter is provided with sufficient freedom of movement and sight while remaining hidden from the game on all sides. In addition, he is protected from wind blowing from any direction while retaining the benefit of the warming rays of the sun. The side of the area enclosed is also sufficient to allow the hunter to view, aim and shoot from within the blind, and preferably while in a sitting position, in any and all directions without extending any portion of his body or his gun out of the blind, thus reducing the possibility of startling the surrounding game.

What is claimed is:

1. A combined camouflaged hunting blind and windbreak comprising a rectangular sheet of flexible material which is substantially longer in width than in height and which is capable of enclosing an area large enough to allow freedom of movement of at least one hunter, said sheet including a main rectangular panel and coextensive therewith an upper elongated rectangular strip, said panel and strip being separate and connected by a plurality of spaced apart connecting means, said separate panel and said separate strip being spaced apart a sufficient distance to form with said connecting means a plurality of elongated openings which provide a substantially unobstructed view therethrough, means for securing said sheet to vertical objects, and a camouflage pattern or one side of said sheet.

2. The combination camouflaged hunting blind and windbreak of claim 1 wherein said rectangular sheet is about 30 to 50 inches in height and about twenty to fifty yards in length.

3. The combination camouflaged hunting blind and windbreak of claim 2 wherein said openings are from about 6 to 8 inches high and from about 1 to 3 feet wide.

4. The combination camouflaged hunting blind and windbreak of claim 1 wherein said securing means comprises at least one rope attached to the sheet along its length and extending beyond the side edges of the sheet.

5. The combination hunting blind and windbreak as set forth in claim 4, wherein said securing means comprise a plurality of ropes attached to said sheet in a vertically spaced relationship relative to the length of said sheet and extend outward beyond the ends of said sheet a sufficient length to provide means for securing said sheet to vertical objects.

6. The combination camouflaged hunting blind and windbreak of claim 5, wherein one of said ropes is connected to said rectangular strip, a second rope is connected to said rectangular panel below said openings and a third rope is provided near the bottom edge of said panel.

7. The combination hunting blind and windbreak as in claim 1 wherein said camouflage pattern resembles at least one of trees, bushes and thick undergrowth as is found in forested areas.

8. A method of forming a hunting blind and windbreak which comprises erecting the hunting blind and windbreak of claim 1 by securing one end of said sheet to a first tree, spreading said sheet to at least substantially its full length and positioning the opened sheet around one or more other trees such that said camouflaged side faces outward and said elongated openings are uppermost, and securing the opposite end of the sheet to said first tree thereby enclosing a space within the permimeter formed by said sheet, said space being protected from view and wind, while being open to the sun.

* * * * *